United States Patent [19]

Wilson et al.

[11] 4,168,993

[45] Sep. 25, 1979

[54] PROCESS AND APPARATUS FOR SEQUENTIALLY FORMING AND TREATING STEEL ROD

[75] Inventors: Norman A. Wilson, Shrewsbury; Asjed A. Jalil, Holden; Vito J. Vitelli, Shrewsbury, all of Mass.

[73] Assignee: Morgan Construction Company, Worcester, Mass.

[21] Appl. No.: 932,646

[22] Filed: Aug. 10, 1978

[51] Int. Cl.[2] ..... C21D 9/52

[52] U.S. Cl. ..... 148/12 B; 148/12.4; 266/114; 266/259

[58] Field of Search ..... 148/12 B, 12.4; 266/114, 259

[56] References Cited

U.S. PATENT DOCUMENTS

| | | | |
|---|---|---|---|
| 3,231,432 | 1/1966 | McLean et al. | 148/12 B |
| 3,666,572 | 5/1972 | Nakagawa et al. | 148/12 B |
| 3,711,338 | 1/1973 | Vitelli | 148/12 B |
| 3,874,950 | 4/1975 | Grozier et al. | 148/12 B |
| 3,930,900 | 1/1976 | Wilson | 148/12 B |

*Primary Examiner*—W. Stallard

*Attorney, Agent, or Firm*—Russell & Nields

[57] ABSTRACT

A process and apparatus for rolling and cooling medium to high carbon steel rod is provided wherein the rod is rolled at high speed and laid in rings directly onto a conveyor at high temperature. Thereafter high velocity hot water is sprayed onto the rings to cool them to a temperature near to but above $A_3$. Transformation is then started while applying air to the rod, and while substantial parts of the rod are transforming, further accelerated cooling is again applied to the rod.

15 Claims, 1 Drawing Figure

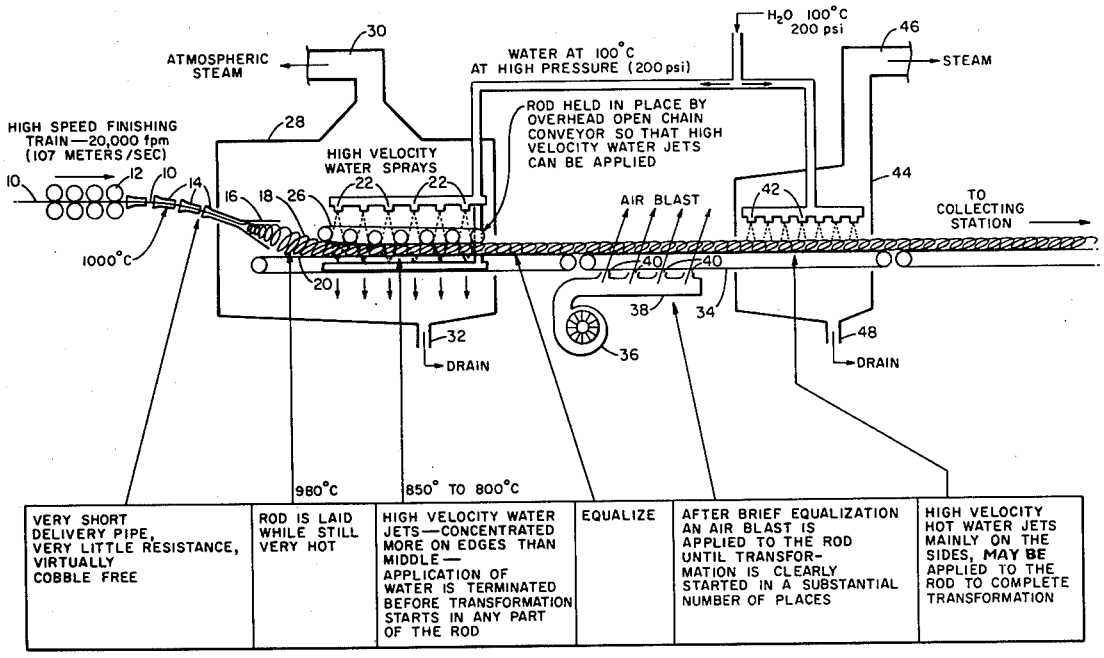

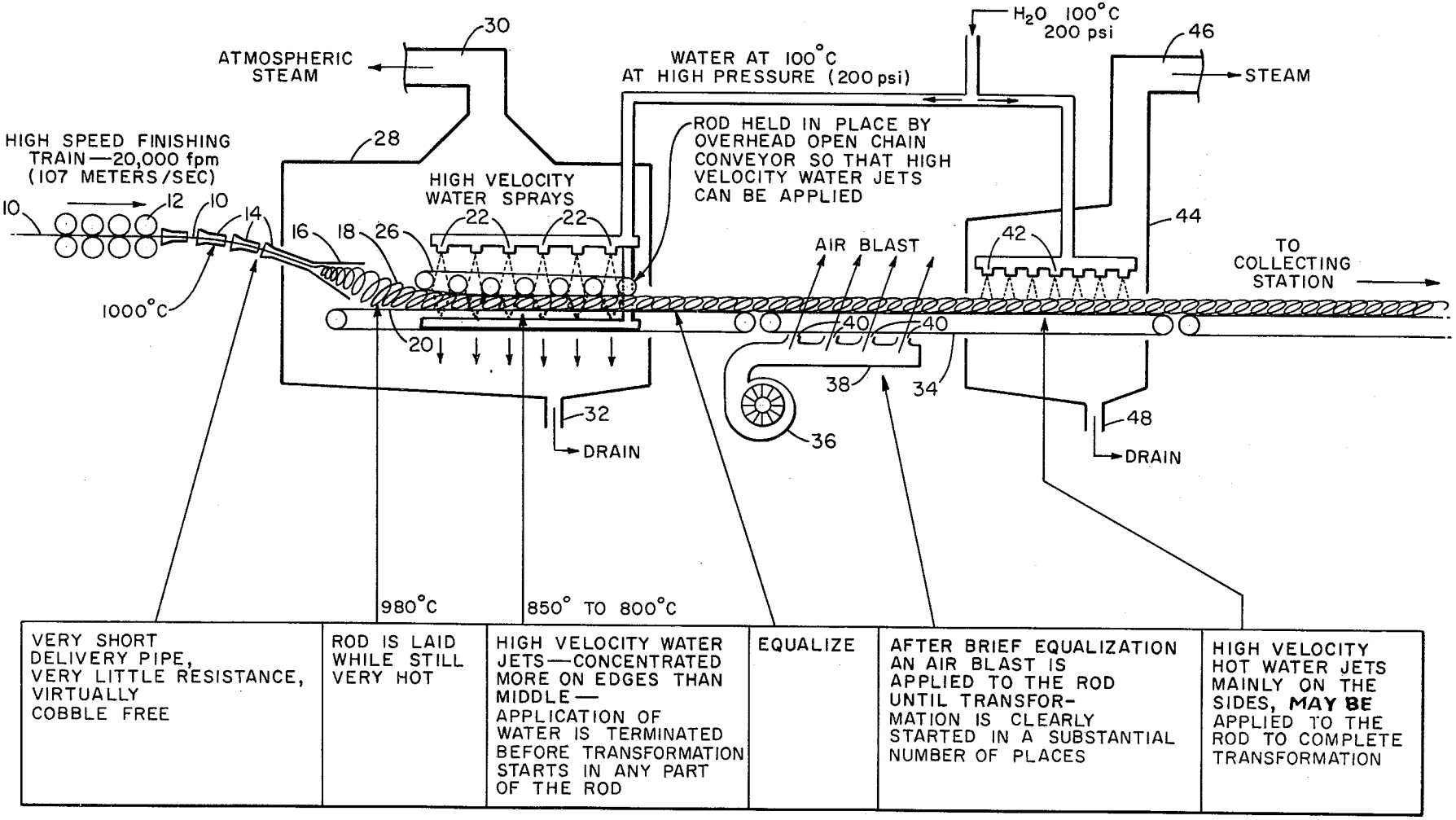
STEAM
46
44
TO COLLECTING STATION
48
DRAIN
$H_2O$ 100°C 200 psi
42
34
40
40
38
36
AIR BLAST
WATER AT 100°C AT HIGH PRESSURE (200 psi)
ROD HELD IN PLACE BY OVERHEAD OPEN CHAIN CONVEYOR SO THAT HIGH VELOCITY WATER JETS CAN BE APPLIED
32
DRAIN
22
22
HIGH VELOCITY WATER SPRAYS
30
20
26
18
16
28
ATMOSPHERIC STEAM
14
10
12
10
HIGH SPEED FINISHING TRAIN—20,000 fpm (107 METERS/SEC)
1000°C
980°C
850° TO 800°C
HIGH VELOCITY HOT WATER JETS MAINLY ON THE SIDES, MAY BE APPLIED TO THE ROD TO COMPLETE TRANSFORMATION
AFTER BRIEF EQUALIZATION AN AIR BLAST IS APPLIED TO THE ROD UNTIL TRANSFORMATION IS CLEARLY STARTED IN A SUBSTANTIAL NUMBER OF PLACES
EQUALIZE
HIGH VELOCITY WATER JETS—CONCENTRATED MORE ON EDGES THAN MIDDLE—APPLICATION OF WATER IS TERMINATED BEFORE TRANSFORMATION STARTS IN ANY PART OF THE ROD
ROD IS LAID WHILE STILL VERY HOT
VERY SHORT DELIVERY PIPE, VERY LITTLE RESISTANCE, VIRTUALLY COBBLE FREE

PROCESS AND APPARATUS FOR SEQUENTIALLY FORMING AND TREATING STEEL ROD

FIELD OF THE INVENTION

This invention relates to hot rolling and cooling steel rod having a medium to high carbon content. The purpose is to obtain a rod product which is suitable for further cold working to a finished product without requiring intervening heat treatment in a substantial number of instances.

BACKGROUND OF THE INVENTION

The present invention stems from the observed fact that once the allotropic transformation of austenite in medium to high carbon content steel has started to take place in a given portion of an elongated steel member which is being cooled non-uniformly, transformation in the adjacent warmer portions of the steel is "sympathetically" triggered and transforms sooner, all other things being equal. This is particularly noticeable in steel immediately after hot rolling and cooling when the cooling is done sufficiently soon after rolling to retain relatively small austenite grains (i.e., in the range of ASTM 6–9). Thus, in the well-known process described in U.S. Pat. No. 3,231,432), when rolling medium to high carbon steel, if one stations himself alongside the conveyor at the appropriate place, one can "see" the transformation start, usually at the center of one ring and proceed rapidly along the rod toward the hotter portions of the rod. What one sees is actually a change in color of the rod from nearly black to red, due to the recalescence of transformation. Thus, in the first parts of the rod to reach transformation, the temperature has descended to a nearly black condition (about 600° C. to 650° C.) and immediately as transformation progresses they turn red again (about 750° C. or possibly higher). Thus, it appears that during cooling, the steel reaches a super-cooled state and when transformation is finally triggered a more-or-less violent release of heat takes place. Thereafter it appears that the triggering proceeds rapidly along the rod and transformation starts elsewhere without the same degree of super-cooling or the same violence of recalescence. This is particularly true when relatively small austenite grains in a highly uniform state are involved. Thus, with such a structure, the transformation conditions for each successive grain are virtually the same, and the triggering chain-reaction is not blocked by the presence of non-conforming grains as occur for example in the mixed grain size structures obtained in typical steel products processed by reheating about $A_3$ and cooling alone.

The foregoing observations actually serve as a basis for understanding why, in the process of U.S. Pat. No. 3,231,432, a relatively uniform product can be obtained even though various parts of the rod are clearly being cooled at very non-uniform rates. Transformation starts at the coolest portions first and proceeds along the rod toward the hotter portions where it triggers the transformation, before those portions reach a super-cooled condition. Transformation proceeds relatively rapidly throughout the rod due both to the triggering chain-reacting and to the smallness of the austenite grains. Thus, the formation of excessive free ferrite is avoided throughout the rod even in the places where the rings overlap and appear to be transforming at a much slower rate. In fact, in the edge areas where the rings overlap and form massed groups, the rod remains red hot continuously, and substantially less recalescence is observed. It is believed, however, that even though the rod is still red hot, the structure has already been effectively transformed at this stage, at least in the sense of inhibiting the further formation of free ferrite, and that this is due to the sympathetic triggering reaction of transformation in adjacent parts of the rod. The result is, therefore, a relatively uniform product despite the obvious non-uniformity of the cooling rate in various parts of the rod.

BRIEF DESCRIPTION OF THE INVENTION

The present invention, therefore, starts from the proposition that uniformity of cooling conditions for steel rod, once thought to be (and still thought to be, by many), an essential criterion for steel rod treatment, is not in fact essential provided the steel has relatively small, highly uniform austenite grains, and further provided the transformation can be started in a substantial number of places in the rod under conditions which avoid the creation of hard spots or serious surface-to-core non-uniformity. Accordingly, in the present invention, immediately after rolling, the rod is preliminarily cooled in the most economic and expeditious way with less emphasis on uniformity of the preliminary cooling. Whereas in the past it has been customary to perform the preliminary cooling in delivery pipes where water can be uniformly applied to the rod, in the present invention, the delivery pipes are eliminated altogether, the rod is simply laid out on a conveyor immediately after rolling, and subjected to cooling by high velocity hot water jets. The only concern at this stage is to keep from cooling any part of the rod so rapidly that transformation will take place under chill-hardening conditions. For this reason, the water applied in the preliminary phase is heated to boiling temperature and is applied intermittently. An overhead open-type chain belt is used to hold the rod in place under both the impact of the high velocity jets and the explosive force of the steam emanating from the rod as the water strikes it. Thus, the cooling at this stage is non-uniform, but no harm results from this non-uniformity because the rod temperature is allowed substantially to equalize thereafter. Subsequently, transformation of the coolest portions of the rod is started only under air blowing conditions. In this way the start of transformation is not done under the rigorous cooling of water, and surface hardening, or non-uniformity of structure from surface-to-core is avoided. Once transformation has started in a major part of the rod, however, and is spreading to the remaining portions of the rod, the cooling can again be accelerated by applying high velocity hot water jets to the rod, especially at the matted edges of the overlapping rings.

BRIEF DESCRIPTION OF THE DRAWINGS

The single FIGURE is a diagrammatic view of the apparatus together with a flow chart of the process steps of the invention.

DETAILED DESCRIPTION OF ILLUSTRATIVE EMBODIMENT

The apparatus components employed in the illustrative embodiment herein shown are either standard components, or are individually well understood in the industry and for that reason they are shown merely in diagrammatic form since the invention resides, not in the specific form of the components, but rather in their combination for the apparatus, and in the combination of the control steps employed in the process.

The context is the hot rolling of medium to high carbon steel rod having a carbon content above about 0.38%C together with varying degrees of other alloying constituents. In particular the invention is adapted for very high speed rolling which has advanced in recent years from about 10,000 fpm (54 meters/sec) in the late 1960's to approaching 20,000 fpm (107 meters/sec) in the present day (1978). It will be understood that cooling rod by the application of water thereto in conventional delivery pipes becomes increasingly difficult as the rolling speed increases and as the delivery pipes must be lengthened. In addition, it is difficult to control the direction of the front end of a billet after it is reduced to rod size and travelling at such speed and at a temperature of 1000° C. in a delivery pipe, especially when the front end may contact free drops of water and must be pushed from behind to a distant point in the delivery pipe. For this reason, pinch rollers may be required to guide the front end. Also, in order to avoid deflecting the front end with water, water cooling is not conventionally applied to the leading end of the rod, and, since the rod in the front end portion therefore receives a different treatment than the remainder of the bundle, the front end in cases where that makes a difference (high carbon, very high manganese) is cut off and discarded. The disadvantages of having to provide longer delivery pipes and pinch rollers, and wasting the front end of the bundle are accentuated as the rolling speed is advanced to modern day speeds of 20,000 fpm.

In the present invention a medium to high carbon content steel rod 10 is rolled and delivered from the final finishing stand of a rolling mill 12 at high velocity into a short section of delivery pipe 14 of conventional form without water cooling, and immediately into a laying head 16 also of conventional construction which forms the rod into rings 18, thereby effectively eliminating the forward velocity of the rod 10.

In order to reduce downstream resistance to the travel of the rod 10 after it leaves mill 12, delivery pipe 14 is either straight, or only slightly bent as shown, and the rotational axis of laying head 16 is either horizontal, or slightly canted downwardly as shown. The degree to which the pipe 14 can be canted downwardly depends upon the delivery speed of the rod. The rotational rate of the laying head is chosen in relation to the curvature of the laying pipe, the circumference of the rings (usually about 10 feet), and the delivery speed of the rod 10, so that the forward velocity of the rod is reduced to a virtual standstill at the point of exit from the laying head 16. The rings 18 then fall downwardly by gravity onto a moving conveyor 20 which conveys them sequentially away from the point of laying and separates substantial portions of each ring from those ahead and behind. As a result the rod surface of each ring is exposed to free access of a cooling medium over substantial parts of its area, but otherwise is left in a relatively unexposed state in areas where it contacts the supporting surfaces, particularly toward the sides of the conveyor where the rings overlap in many places and tend to run close together and parallel to each other.

Conveyor 20 is relatively open so as to permit the passage of a cooling medium therethrough. A suitable form of conveyor is shown in U.S. Pat. No. 3,231,432 employing spaced bars to support the rod, and chains to move the rod along the conveyor by means of upstanding lugs on the chains which contact the rod. Other forms of conveyor employing spaced, individually driven rollers, or screen belts are also suitable as long as they are designed to permit the cooling medium to contact the rod when desired and to let it drain away from the rod at the appropriate time as explained below.

The conveyor 20 is driven at a forward velocity of about 50 to 200 fpm so as to provide an average spacing between rod centers of rings of about $\frac{1}{3}''$ and $1\frac{1}{3}''$ and, immediately after the rings 18 come to rest on the conveyor, cooling water at boiling temperature is sprayed under high pressure (20–50 psi) through nozzles 22 onto all parts of the rings 18. The nozzles are only shown as being directed downwardly but directing them upwardly through the conveyor from below the rings is also desireable. The temperature of the water is regulated so as to reduce the cooling effect thereof. The reason for this is that, water at ambient temperature cools the rod too rapidly, and cannot be controlled so as to avoid either chill-hardening the rod surface or giving the rod surface a significantly different structure than the core. The result of such differences in surface-to-core structure, is that during subsequent cold formation, the work-hardening process in the steel proceeds non-uniformly and thereby promotes subsequent failure in the finished product unless the steel is subjected to intermediate and costly heat treatment.

The cooling effect of the water is reduced by heating the water to approximately 100° C. and, while holding it under pressure, adding sufficient heat to it to supply a substantial portion of the latent heat of vaporization. With the water in this condition, when it is sprayed onto the rod, it immediately boils and absorbs heat from the rod, but it does not absorb the full value of the latent heat of vaporization. In this way, a less drastic cooling effect is attained than can be done with the water at ambient temperature, but greater cooling is obtained than can be done with mere gaseous convection.

Since the boiling of the water occurs virtually instantaneously as it contacts the rod and since the water is propelled under high velocity, the rings 18 tend to be displaced both by the spray force and by the escaping steam. In order to keep them in position, an overhead chain belt or conveyor 26 running parallel to conveyor 20 is positioned over rings 18 spaced about six inches above their top level when at rest. The water application causes them to bounce and shift but the conveyor 26 retains them adequately in place. Side barriers (not shown) parallel to conveyor 20 may also be used to retain the rings 18 from shifting laterally.

Due to the bouncing and shifting during spraying, the water effectively reaches all parts of the rod, although the cooling effect is greater wherever portions of the rings appear alone and not in contact with each other or with a support. The increased cooling of these latter, exposed parts occurs mainly in the middle of the conveyor but it also occurs on the sides where a single strand often stands apart from the others. The cooling is, however, less on the sides, on the average.

The water sprays are applied at spaced stations to permit a degree of equalization between cooling steps and to avoid over cooling any part of the rod.

When the rod 10 issues from the mill it is at approximately 1000° C. Very little convective cooling takes place before it reaches the laying head, but since the loss of heat through radiation is unavoidable and proceeds comparatively rapidly at 1000° C., by the time the rod is laid on the conveyor 20 its temperature has already dropped to about 980° C. At this point the rod temperature is about 240° C. above $A_3$. In addition, at this stage the austenite grains in the steel which were fractured during the final rolling stage are recrystallizing and reforming very rapidly under conditions of ample excess heat above $A_3$. At this temperature the austenite grains rapidly merge to form larger grains. In addition, due to the excess heat above $A_3$ the merging process takes place highly uniformly throughout the steel. The growth of the austenite grains, however, is rapidly arrested by the preliminary cooling of the hot water jets. In most plain carbon steels, there is a critical temperature, usually around 950° C. above which the grain size increases rapidly. Accordingly, the preliminary cooling step rapidly cools the rod below 900° C. and thereby prevents further rapid grain growth. The preliminary cooling is then continued until the temperature of the rod is reduced to an average of about 800° C., and prior to the point where any portion of the rod has reached $A_3$ (approximately 740° C.). In the present example, the water spray area is 20 feet long, five rows of transversely arranged spray heads 22 are used, with the rows spaced four feet apart longitudinally of the conveyor. Thus, assuming a conveyor speed of about 120 fpm, in a period of about 10 seconds, the rod temperature is reduced from 1000° C. to about 800° C.

In order to trap, convey away, and conserve the energy of the large volume of steam created, the preliminary cooling area is enclosed in a housing 28. The steam is taken away through a conduit 30 and any unconverted water remaining is drawn off through a drain 32 at the bottom. This arrangement also permits the water jets to wash out the preliminary cooling area, between billets.

After the preliminary cooling step, the rod temperature is allowed to equalize from surface to core, and the rings start cooling by radiation and natural convection, with the temperature of many parts of the rod now approaching $A_3$ while other parts are still about $A_3$. At this point the rings 18 come to the end of conveyor 20 and transfer to a second conveyor 34 where they are subjected to an air blast emanating from fan 36 through plenum chamber 38 and air nozzles 40. The forced convective cooling of the air now rapidly depresses the temperature of the rod with the more exposed portions cooling more rapidly. The cooling rate of the most exposed portions is about 10° C./sec and they become relatively black (about 630° C.) in about 10–12 seconds. At this point, while the rings are still in the area of the air blast, transformation of the austenite starts at the coolest places and rapidly spreads along the rod in both directions toward the hotter places. The reaction is exothermic and recalescence immediately sets in such that the rod color returns to a fairly bright red of about 750° C. which change of color can be seen to progress laterally until it reaches the warmer rod where the contrast in color disappears. At this point transformation is proceeding from the exposed portions of the rod into the massed areas where the overlapping rings are matted together. In this condition, the exposed portions are already effectively transformed, their internal microstructures are essentially fixed, and no harm thereto (in the sense of chill hardening) can be done by rapid quenching. Since those portions reached transformation, however, in a relatively equalized state (surface-to-core), and since they were being cooled relatively mildly in air at the time but at a sufficiently fast rate to suppress the formation of excessive amounts of free ferrite, their microstructures are suitable for extensive cold working to finished products (in many cases) without requiring intervening heat treatment.

The remaining portions are also starting to transform by virtue of the sympathetic triggering of transformation as it proceeds along the rod from the already transformed parts.

At this point the rings may be subjected to high velocity hot water jets 44 within housing 44 from which the steam is conducted in a conduit 46 and excess water is taken off through a drain 48.

The hot water increases the cooling rate to about 20° C./sec on the exposed strands, but it cannot reach the matted, hotter areas as easily. Thus they cool at a somewhat slower rate, and cool while the transformation line proceeds into the matted, hotter areas from the outside. Such non-uniformity of cooling rates, however, causes virtually no harm to the rod because the colder parts are already transformed and the warmer untransformed parts remain in a matted condition where chill-hardening cooling rates cannot be achieved anyway. In the final stage, water or air cooling is continued until transformation is completed and the advancing rings are totally black. At this point the steel throughout the bundle is all relatively uniform in microstructure and may be cold worked to finished product in many cases without requiring patenting.

Various ways to arrange and control the components described are available. For example, the preliminary cooling stage can be lengthened and transformation can be completed in the preliminary stage provided the cooling medium is preheated sufficiently to avoid chill-hardening of the rod. Conversely, if a more drastic preliminary cooling is desired the water need not be heated to near boiling so that the full latent heat of vaporization will be absorbed when the water strikes the rod. In addition, the final stage cooling can be done by a continuation of the air blast followed by the application of water immediately before collecting the rod into a bundle. Such a process is adequate for metallurgical reasons.

Another variable has to do with the nature of the conveyor and the manner of applying the cooling water. Thus, although the water sprays may be regarded as substantially immersing the rod in water, if a complete, total immersion in the cooling water is desired, a less permeable wire mesh type conveyor may be employed, in order to permit the water to accumulate on the conveyor and surround the rings. The jets also can be directed not only from above and below but also inwardly from the sides or at an angle along the conveyor. In fact, directing the jets upwardly at an angle calculated to make the rings lift as the cooling water hits them, is desireable.

Recycled mill water is employed in the preferred embodiment but one may also add soaps, and other ingredients to the water for the purpose of raising or lowering the boiling point and/or increasing or decreasing the heat transfer from the rod surface into the water. Other liquids such as oil, molten salt, etc. may be used.

The arrangement described has very significant economic consequences in that it permits very high speed sequential steel rod rolling and treating with a relatively short finishing and cooling outlet, and at the same time providing a rod which is suitable for cold working to a finished wire product without requiring patenting.

We claim:

1. A process for forming and treating steel rod comprising the steps of:

(a) continuously hot rolling steel into rod form at high speed at a temperature substantially above $A_3$ and producing therein an austenitic grain structure immediately after rolling in which extremely small uniformly dispersed austenite grains, formed by recrystallization throughout the cross-section, are rapidly combining to form larger grains under conditions of excess heat above $A_3$;

(b) reducing the forward velocity of said rod to a substantial standstill by coiling same into rings;

(c) moving said rings away from the point of coiling to provide gaps between substantial portions of each successive ring;

(d) cooling said rings by substantially immersing them sequentially in a liquid cooling medium directly after coiling them and while moving them;

(e) successively terminating the immersion of the rings in said medium before the temperature of any part of any ring has descended below the knee of the outer curve of the transformation diagram of the particular steel in process;

(f) successively blowing air on said rings to further cool same until transformation of the austenite starts at a multiplicity of places around said rings successively, and thereafter, (g) further successively cooling the remaining portions of said rings until transformation of the austenite is complete.

2. The process defined in claim 1 further characterized by the cooling medium being water.

3. The process defined in claim 1 further characterized by reducing the cooling effect of said medium by preheating same.

4. The process defined in claim 1 further characterized by applying said medium to said rings intermittently and allowing the surface-to-core temperature of said rod to equalize between applications.

5. The process defined in claim 1 further characterized by spraying said cooling medium onto said rod at high velocity.

6. The process defined in claim 1 further characterized by said medium being water, and employing the water to shift the position of the rings relative to each other by forcing said water between said rings while the temperature thereof is above the knee of the outer curve of the transformation diagram of the particular steel in process.

7. The process defined in claim 6 further characterized by preheating said water to a temperature of about 100° C.

8. The process defined in claim 1 further characterized by performing the cooling final step by means of cooling water sprays.

9. A process for forming and treating steel rod comprising the steps of:

(a) continuously hot rolling steel into rod form at high speed at a temperature substantially above $A_3$ and producing therein an austenitic grain structure immediately after rolling in which extremely small uniformly dispersed austenite grains, formed by recrystallization throughout the cross-section, are rapidly combining to form larger grains under conditions of excess heat above $A_3$;

(b) reducing the forward velocity of said rod to a substantial standstill by coiling same into rings directly after rolling;

(c) moving said rings away from the point of coiling to provide gaps between substantial portions of each successive ring;

(d) intermittently cooling said rings by substantially immersing them sequentially in water for successive brief periods directly after coiling them and while moving them;

(e) reducing the cooling effect of said water to a minimum by preheating same virtually to its boiling point;

(f) terminating the immersion of said rod in said cooling water and said cooling step before the temperature of any part of said rod has descended below the knee of the outer curve of the transformation diagram of the particular steel in process; and thereafter, (g) cooling at least a substantial portion of said rod through transformation by the application thereto of a gaseous cooling medium.

10. Apparatus for forming and treating steel rod comprising:

(a) means for continuously hot rolling steel rod into form at high speed at a temperature substantially above $A_3$ and producing therein an austenitic grain structure immediately after rolling in which extremely small uniformly dispersed austenite grains, formed by recrystallization throughout the cross-section, are rapidly combining to form larger grains under conditions to excess heat above $A_3$;

(b) means for coiling said rod into rings directly after rolling;

(c) means for moving said rings away from the point of coiling to provide gaps between substantial portions of each successive ring;

(d) first means for cooling said rings by substantially immersing them sequentially in a liquid cooling medium directly after coiling them and while moving them;

(e) means for successively interrupting the cooling of the rings in said medium before the temperature of any part of said rod has descended below the knee of the outer curve of the transformation diagram of the particular steel in process;

(f) second means for thereafter air cooling said rings successively until substantial portions of the austenite therein starts to transform; and (g) third means for thereafter further cooling the remaining portions of said rings through transformation successively.

11. The apparatus defined in claim 10 further characterized by said first cooling means comprising means for spraying said medium onto said rings.

12. The apparatus defined in claim 10 further characterized by said first cooling means adapted to apply water to said rod, and means for housing said first cooling means to collect, convey away, and conserve the energy of the steam resulting from the application of said water to said rod.

13. The apparatus defined in claim 10 further characterized by said first and third cooling means comprising high velocity water jets arranged to impinge water at high velocity onto said rings and to shift them relative to each other.

14. Apparatus for forming and treating steel rod comprising:

(a) means for continuously hot rolling steel into rod form at high speed at a temperature substantially above $A_3$ and producing therein an austenitic grain structure immediately after rolling in which extremely small uniformly dispersed austenite grains, formed by recrystallization throughout the cross-section, are rapidly combining to form larger grains under conditions of excess heat above $A_3$;

(b) conveyor means for moving said rings away from the point of coiling to provide gaps between substantial portions of each successive ring;

(d) means for applying a high velocity jet of a liquid coolant to each ring successively, both to cool said rings and to cause said rings to move relatively to each other while cooling.

15. The apparatus defined in claim 14 further characterized by means for successively lifting said rings while said coolant is being applied, and further means for retaining said rings loosely in position on said conveyor means.

* * * * *